US006517025B1

(12) United States Patent
Budz

(10) Patent No.: US 6,517,025 B1
(45) Date of Patent: Feb. 11, 2003

(54) LOW RESERVE INDICATOR FOR A CORELESS PAPER TOWEL DISPENSER

(75) Inventor: Gregory D. Budz, Sobieski, WI (US)

(73) Assignee: Georgia-Pacific Corporation, Atlanta, GA (US)

( * ) Notice: Subject to any disclaimer, the term of this patent is extended or adjusted under 35 U.S.C. 154(b) by 0 days.

(21) Appl. No.: 09/713,317

(22) Filed: Nov. 16, 2000

(51) Int. Cl.[7] ..... B65H 43/00
(52) U.S. Cl. ..... 242/563; 242/912
(58) Field of Search ..... 242/593, 563, 242/563.2, 912; 116/243; 312/234

(56) References Cited

U.S. PATENT DOCUMENTS

| | | | | | |
|---|---|---|---|---|---|
| 1,738,721 | A | | 12/1929 | Morin | |
| 2,601,956 | A | | 7/1952 | Birr | |
| 3,273,773 | A | | 9/1966 | Eder | |
| 3,292,170 | A | * | 12/1966 | D'Angelo | 340/675 |
| 4,204,180 | A | * | 5/1980 | Usui et al. | 335/205 |
| 4,760,970 | A | * | 8/1988 | Larsson et al. | 242/422.5 |
| 5,765,718 | A | * | 6/1998 | Grasso et al. | 221/62 |
| 5,884,861 | A | * | 3/1999 | Hosomi et al. | 242/563 |
| 6,089,499 | A | | 7/2000 | Robinson | |
| 6,267,321 | B1 | * | 7/2001 | Tramontina | 242/593 |
| 6,326,252 | B1 | * | 12/2001 | Neveu et al. | 242/593 |

* cited by examiner

*Primary Examiner*—Donald P. Walsh
*Assistant Examiner*—Joseph Rodriguez
(74) *Attorney, Agent, or Firm*—Burns, Doane, Swecker & Mathis, LLP

(57) ABSTRACT

A paper towel dispenser contains an upright roll of paper towels having an inner periphery from which the towels are dispensed. A low-reserve indicator mechanism is affixed to the housing within the chamber for indicating when a remaining quantity of towels in the roll is low. The indicator mechanism includes a sign mounted for movement between a retracted position and an indicating position for displaying indicia through a transparent portion of the housing when the roll is low. The indicator mechanism also includes a release mechanism supported upon an upper end of the roll and movable downwardly in response to becoming unsupported by a diminishing radial thickness of the roll to cause the indicator to move to its indicating position. The indicator mechanism automatically conforms to rolls of varying height and outer diameter.

27 Claims, 6 Drawing Sheets

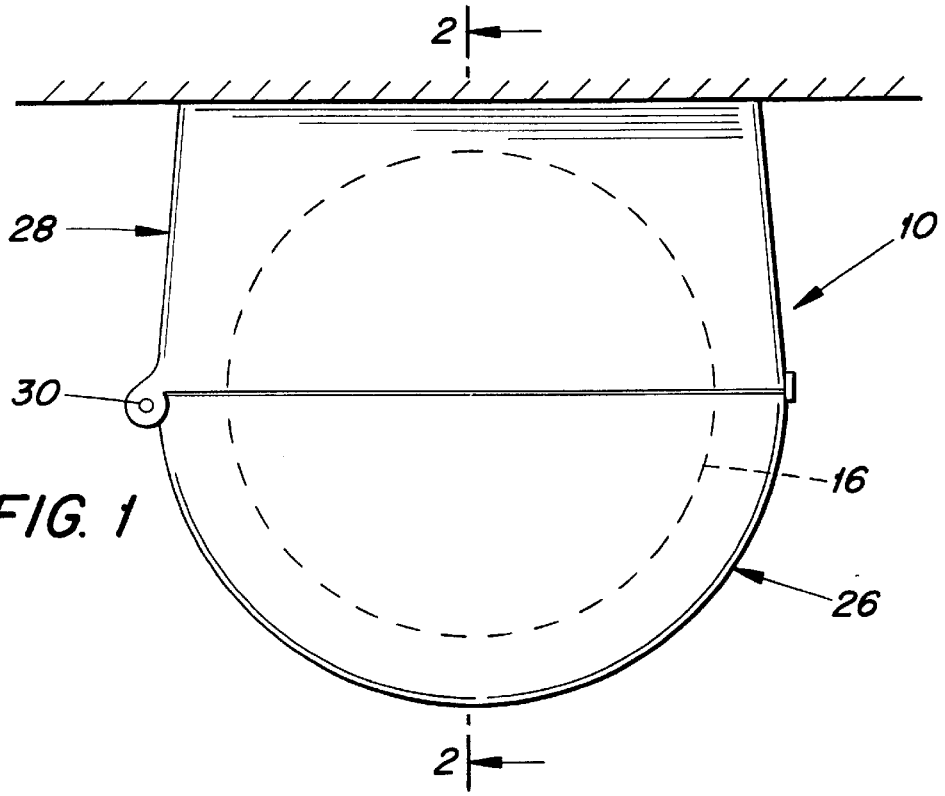
FIG. 1
FIG. 2
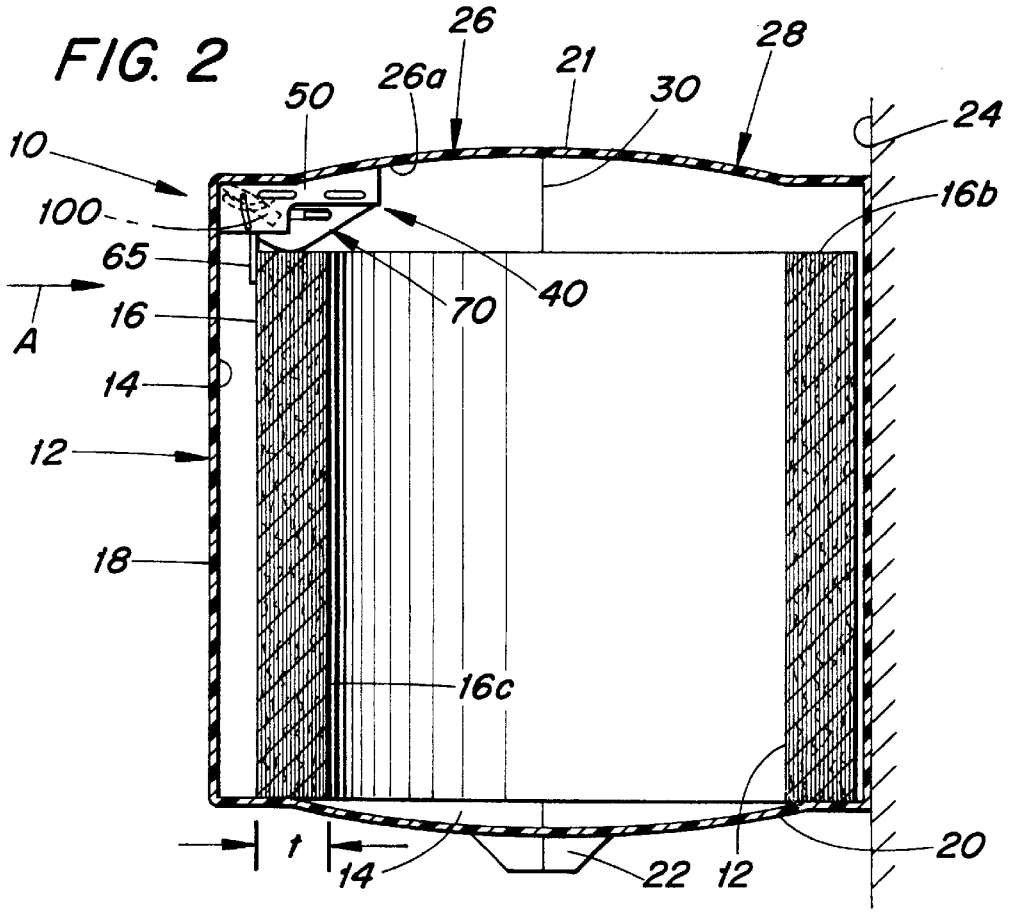

FIG. 10
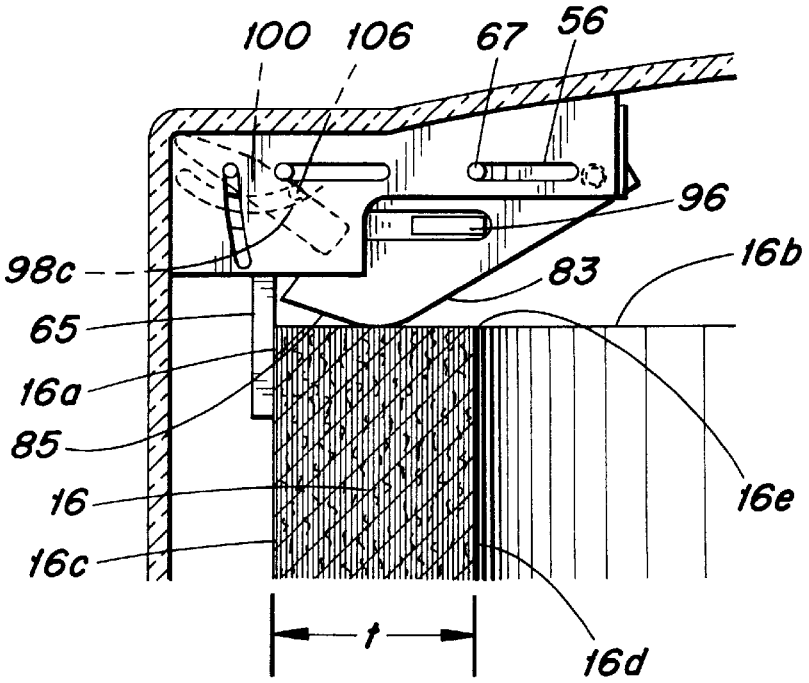
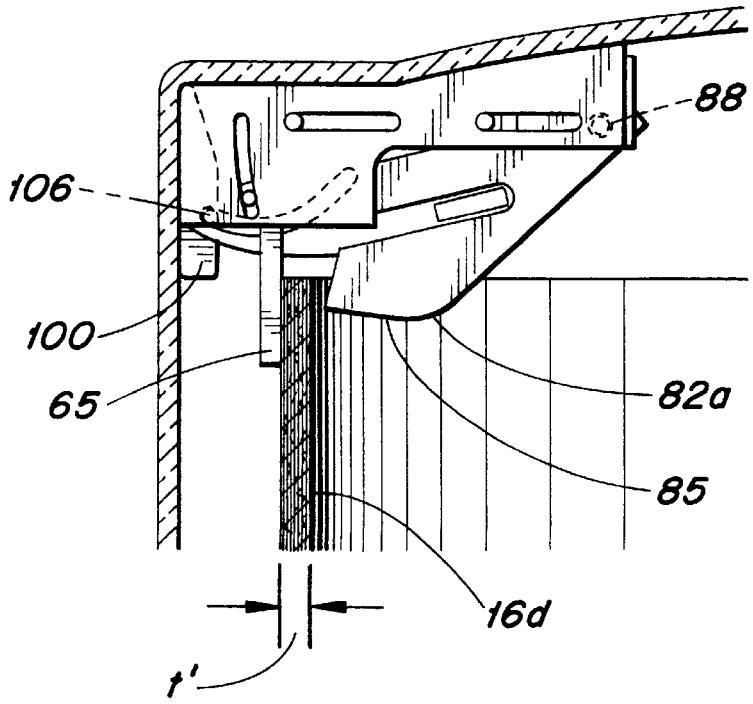
FIG. 11

FIG. 12
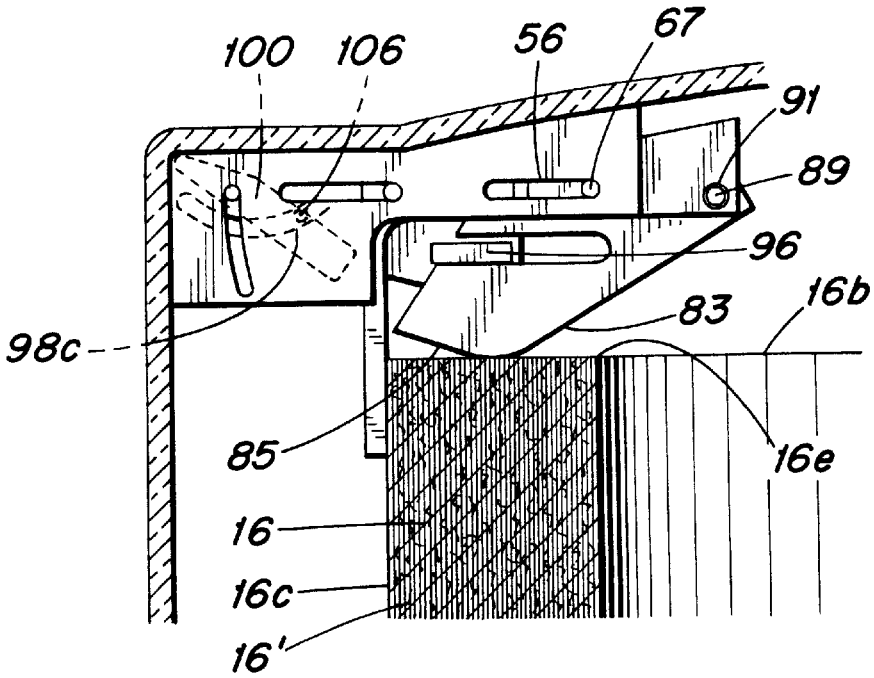
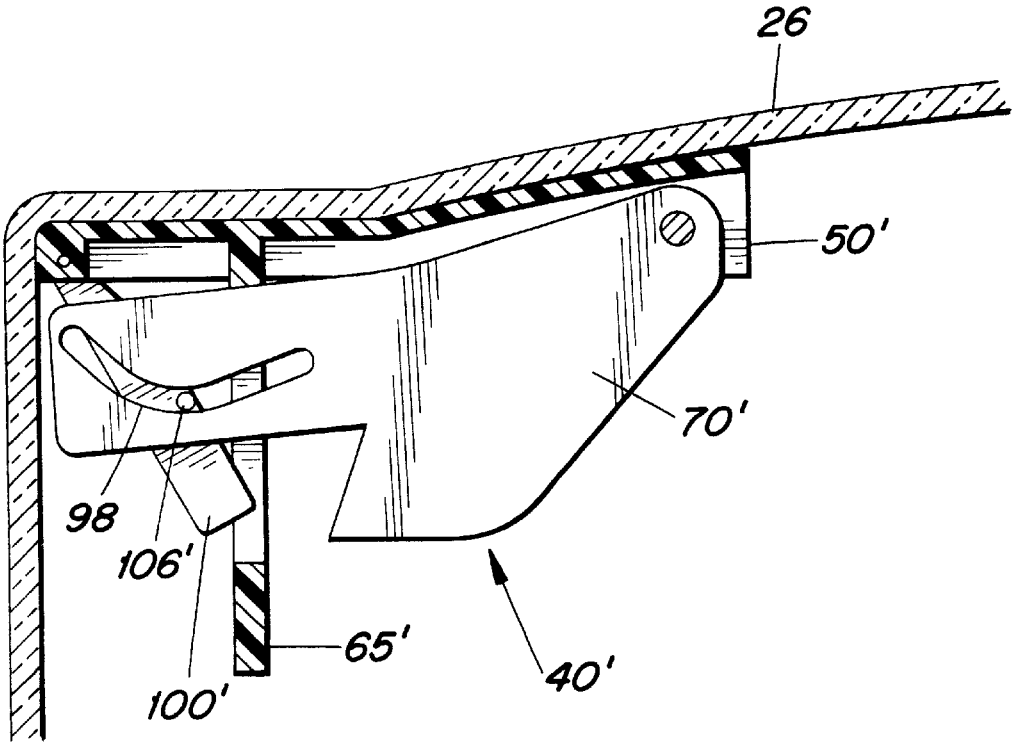
FIG. 15

LOW RESERVE INDICATOR FOR A CORELESS PAPER TOWEL DISPENSER

BACKGROUND OF THE INVENTION

The present invention relates to an indicator for alerting users that the paper remaining in a paper towel dispenser is low. In particular, the indicator is for use with a dispenser that houses an upright coreless roll of paper towels that are dispensed from an inner periphery of the roll.

It is conventional to dispense paper towels from an upright roll, i.e., a roll whose center axis is oriented vertically. The center of the roll is coreless, so the paper can be pulled from the inner periphery of the roll, i.e., usually downwardly through a hole formed in a floor of a dispenser housing.

Therefore, the radial thickness of the roll gradually diminishes from a roll inner periphery toward a roll outer periphery. Eventually, only a very small radial thickness of the roll remains. It would be desirable for the user to be informed when the paper reserve is low.

Low-reserve indicators have been previously proposed for paper towel dispensers of the type wherein individual towels are arranged in a vertical stack (see U.S. Pat. No. 1,738,721), or in a horizontal roll (see U.S. Pat. Nos. 2,601,956 and 3,273,773). However, such indicators are not suitable to a vertically oriented roll, let alone a coreless roll whose towels are pulled from the inner periphery of the roll.

It is, therefore, an object of the present invention to provide a low-reserve indicator for a paper towel dispenser of the type wherein the towels are dispensed from the inner periphery of an upright coreless roll.

It would also be desirable to provide such an indicator which is adaptable to rolls of different height and outer diameter.

SUMMARY OF THE INVENTION

The present invention involves a paper towel dispenser which is adapted for containing an upright roll of paper towels having an inner periphery exposed in use from which the towels are dispensed. The dispenser includes a dispenser housing having a wall structure that forms an inner chamber adapted to support the upright roll. The wall structure includes a vertically open dispensing aperture therein for dispensing towels from the roll inner periphery. A low-reserve indicator mechanism is affixed to the dispenser housing within the chamber for indicating when a remaining quantity of towels in the roll is low. The indicator mechanism includes an indicator and a release mechanism. The indicator is mounted for movement between a retracted position and an indicating position for establishing a low-reserve indication which is detectible from outside of the dispenser housing. The release mechanism is adapted to be supported upon an upper end of the roll adjacent an outer periphery thereof. The release mechanism is movable downwardly in response to becoming unsupported by a diminishing radial thickness of the roll. The release mechanism is operably connected to the indicator to cause the indicator to move to its indicating position in response to the release mechanism moving downwardly.

The invention also pertains to the low-reserve indicator per se.

BRIEF DESCRIPTION OF THE DRAWINGS

The objects and advantages of the invention will become apparent from the following detailed description of preferred embodiments thereof in connection with the accompanying drawings in which like numerals designate like elements and in which:

FIG. 1 is a plan view of a prior art dispenser;

FIG. 2 is a vertical sectional view taken along line 2—2 in FIG. 1, depicting an upright coreless roll of paper towels disposed within the dispenser, and a low-reserve indicating mechanism according to the present invention;

FIG. 10 is a fragmentary vertical sectional view taken through the dispenser of FIG. 1 with the indicator mechanism associated with a first roll of paper towels;

FIG. 11 is a view similar to FIG. 10 after the indicator mechanism has indicated that the remaining quantity of towels in the roll is low;

FIG. 12 is a view similar to FIG. 10 wherein the dispenser contains a roll of paper towels having a smaller outer diameter than the roll of FIG. 10;

FIG. 15 is a view similar to FIG. 10 showing an alternative form of indicator mechanism.

DETAILED DESCRIPTION OF PREFERRED EMBODIMENTS OF THE INVENTION

Figure 3:
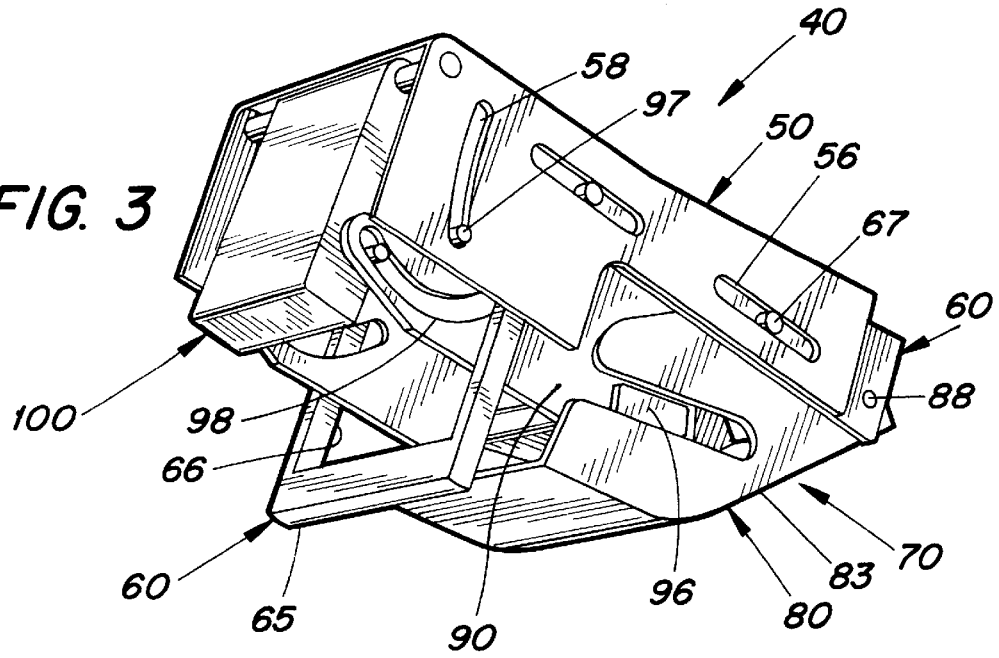
FIG. 3 is a bottom front perspective view of a low reserve indicator mechanism according to the present invention.
Figure 4:
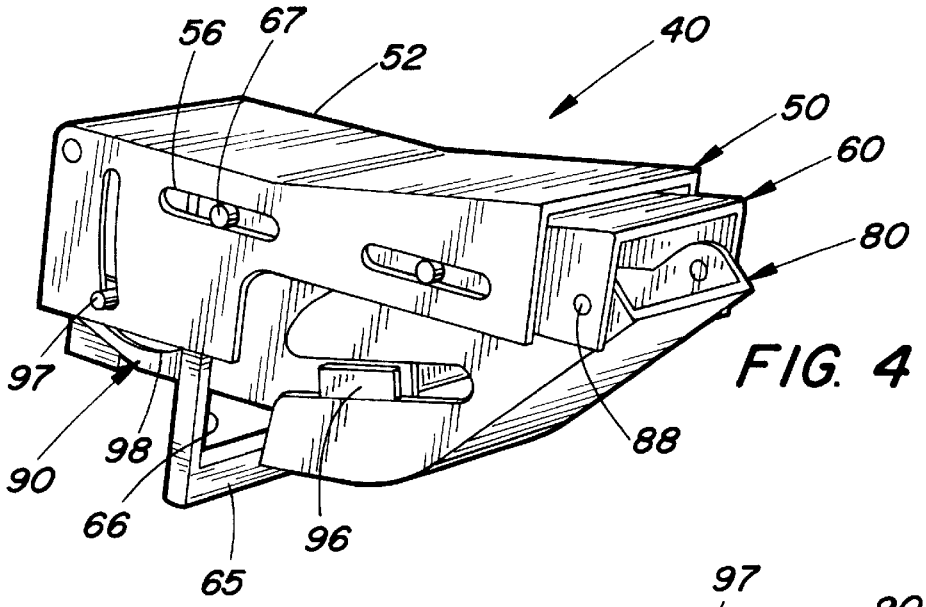
FIG. 4 is a rear top perspective view of the indicator mechanism depicted in FIG. 3.
Figure 5:
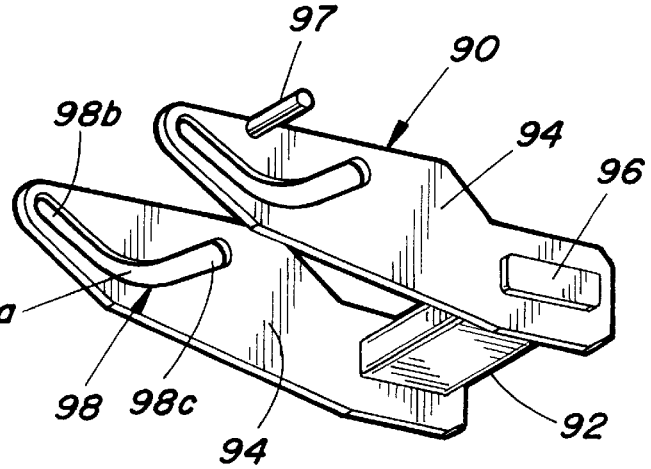
FIG. 5 is a bottom front perspective view of a release portion of a release mechanism according to the present invention.

Depicted in FIGS. 1 and 2 is a paper towel dispenser 10 which dispenses towels from a roll 16 of paper towels from an inner periphery 12 of the roll that has no center core when disposed in the dispenser. The dispenser housing includes an upright side wall 18, a floor 20, and a cover 21, together forming an internal chamber 14 for housing the roll 16. The floor 20 includes a central opening 22 through which the towels can be dispensed.

A rear side of the dispenser is to be affixed to a wall 24, so that the central opening 22 is spaced from the wall. In a conventional manner, the a dispenser is split into front and rear sections 26, 28 about a vertical parting line, and the dispenser is hinged at 30 along a vertical side of the parting line, to enable the generally semi-cylindrically shaped front section 26 to be swung open about that hinge, whereby a roll 16 can be inserted. Afterwards, the centermost towel is pulled partially down through the opening, and the front section is closed 26, whereupon the dispenser is ready to dispense. A releasable latch 31 of any suitable type is provided for securing the housing sections 26, 28 a closed state.

As the roll 16 becomes depleted, its radial thickness t becomes gradually diminished. In order to warn a user or custodian when the remaining number of towels in the roll reaches a low state, the low-reserve indicator 40 is provided.

Figure 6:
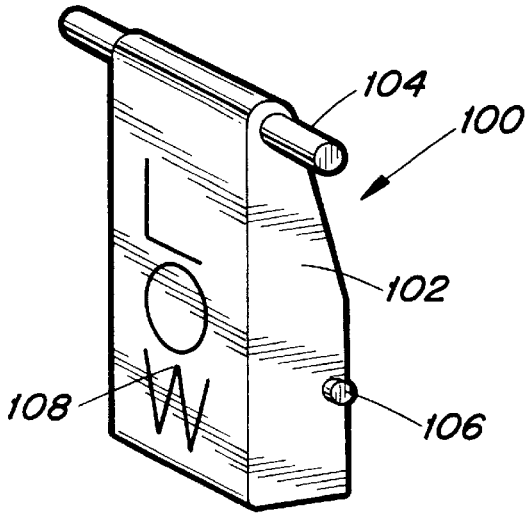
FIG. 6 is a front perspective view of an indicator sign of the indicator mechanism.

A first embodiment of the indicator 40, depicted in FIGS. 2–11, comprises an upper housing 50 (FIG. 8), a pusher member 60 (FIG. 7), a release mechanism 70 including a release arm 80 (FIG. 9) and a release slide 90 (FIG. 5), and a sign 100 (FIG. 6).

The upper housing 50 (FIG. 8) is adapted to be fixed to an underside 26*a* of the dispenser, e.g., by a double-backed adhesive (not shown) which can be attached to a top wall 52 of the upper housing 50. Depending downwardly from the top wall 52 are two identical parallel side walls 54, each including a pair of horizontal guide slots 56, a curved, generally vertical guide slot 58, and a pivot hole 59. The slots 56 and 58 of each side wall 54 are horizontally aligned with respective slots of the other side wall 54. Also depending from the top wall 52 is a leg 53 adapted to support a rear end of a coil spring 69, as will be discussed.

The pusher member 60 (FIG. 7) includes a top wall 62 disposed beneath the top wall 52 of the upper housing 50, a pair of side walls 64 disposed parallel to, and inside of, the side walls 54 of the upper housing, and a front pusher arm or wall 65 depending downwardly from a front end of the top wall 62 and side walls 64. The pusher arm 65 includes an aperture 66 for accommodating movement of the sign 100, as will be explained. Projecting outwardly from the exterior surface of each of the side walls 64 are two guide pins 67. Those guide pins 67 are slidably received in respective horizontal slots 56 of the upper housing 50 to define a pin-and-slot connection to enable the pusher member to slide relative to the base. A pivot hole 68 is situated at a rear end of each side wall 64 to support the supporting portion 80 of the release mechanism 70. Depending downwardly from a front end of the top wall 62 is a leg 66 that supports a front end of the spring 69. It will be appreciated that the spring 69 yieldably biases the pusher member toward the center of the housing for reasons to be explained.

The release arm 80 (FIG. 9) includes a bottom wall 82 and two side walls 84 extending upwardly from the bottom wall 82. The bottom wall 82 includes a rearwardly facing portion 83 which extends generally upwardly and rearwardly to enable the release arm to be cammed upwardly upon engaging a roll of paper towels when the dispenser is closed, as will be explained. Each side wall 84 includes a guide slot 86 extending in a generally front-to-rear direction. A front end of each guide slot 86 is open, whereas a rear end 87 thereof is closed. Each side wall 84 includes a hole 88 aligned with a respective pivot hole 68 of the push plate 60, whereby an axle rod 89 (FIG. 12) can be inserted through the holes 68, 88 to establish a pivot connection enabling the release arm 80 to pivot up and down. The front end of the release arm 80 is thus able to move up and down. One or more torsion springs 91 (see FIG. 12) are provided at the axle 89 to yieldably bias the release arm for counter-clockwise rotation as viewed in FIG. 12.

The release slide 90 (FIG. 5) includes side walls 94 and a connector 92 interconnecting rear ends of the side walls 94. Projecting outwardly from a rear end of each side wall 94 is a guide projection in the form of a rectangular-shaped pin or lug 96 that is slidably disposed in a respective slot 86 of the release arm 80 to define therewith a pin-and-slot connection. A projection in the form of a guide pin 97 projects laterally outwardly from each side wall 94 at a location forwardly of the guide pin 96. The guide pins 97 extend through respective guide slots 58 of the upper housing 50 to define therewith a pin-and-slot connection. Formed in the side wall 94 forwardly of the guide pin 97 is a slot 98 of generally U-shape. The slot 98 includes a central apex portion 98*a* and front and rear portions 98*b*, 98*c* extending generally upwardly from the apex portion.

Figure 14:
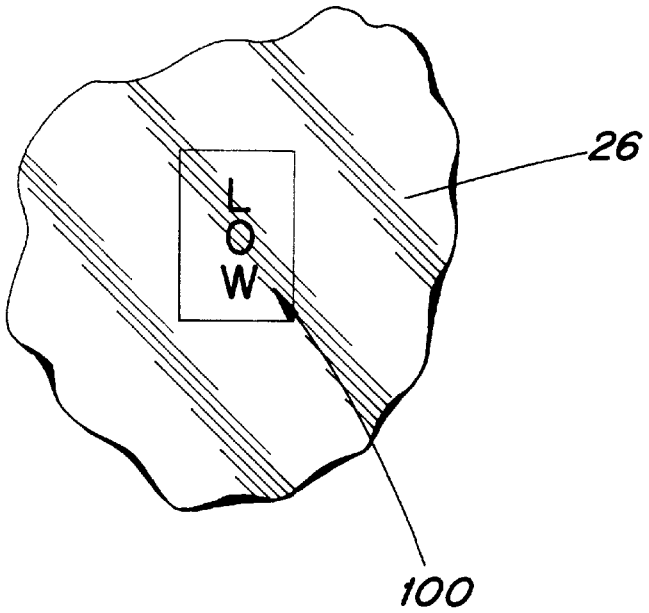
FIG. 14 is a fragmentary view of a sidewall of the dispenser taken in the direction of arrow A in FIG. 2, when the low reserve indicator mechanism indicates that the remaining quantity of paper towels on the roll is low.

The sign 100 (FIG. 6) includes a body 102 having a pair of laterally projecting pivot pins 104 mounted in respective ones of the pivot holes 59 of the upper housing to enable the sign 100 to swing between a rear (retracted) position (FIG. 10) and a forward or indicating (extended) position (FIG. 11). The sign also carries pins 106 disposed in the slots 98 to form therewith a pin-and-slot connection. A front face 108 of the sign 100 carries indicia, such as the word "low" which is visible to a user or custodian when the sign is in the forward position (see FIG. 14).

To enable the indicia to be visible, the front section 26 of the dispenser housing is preferably formed of a transparent material, such as a tinted acrylic. Alternatively, a window could be formed in the housing section 26 through which the indicia could be seen.

Figure 13:
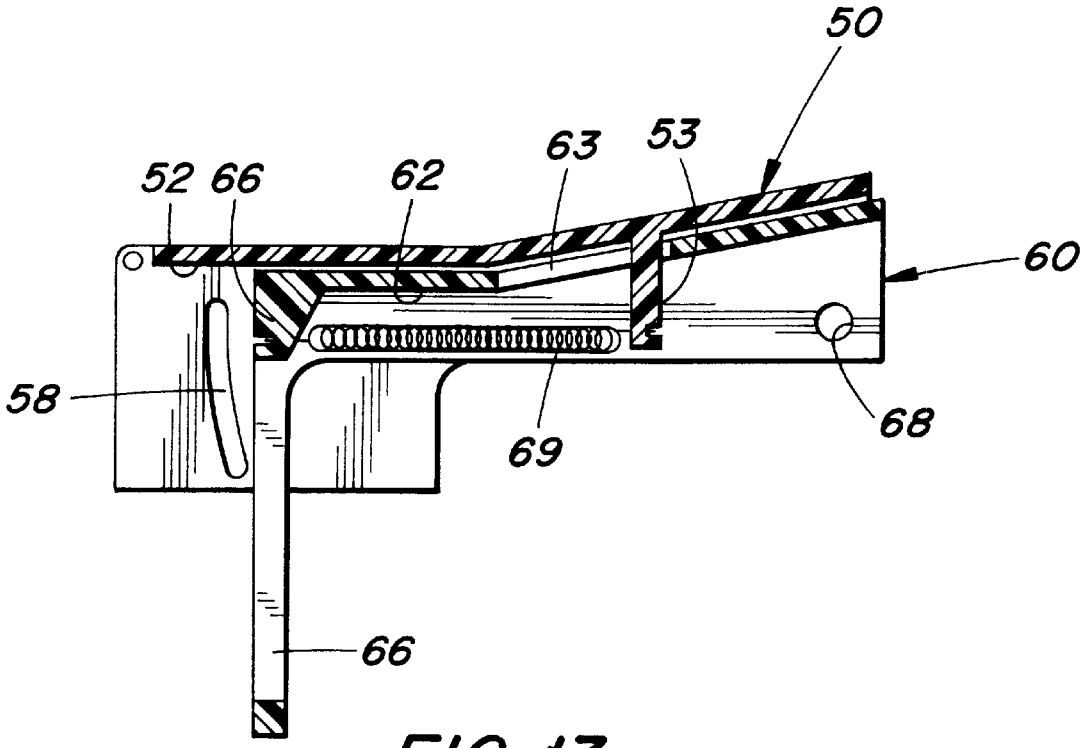
FIG. 13 is a sectional view taken through two components of the low reserve indicator mechanism.

The operation of the low-reserve indicating mechanism will now be explained with particular reference to FIGS. 10 and 11. In operation, a coreless roll 16 of paper towels is mounted in an upright state within the cavity 14 of the dispenser. When the front half 26 of the dispenser is then closed, the indicating mechanism (which is fixed to the underside 26*a* of the front half 26 of the dispenser) approaches cylindrical outer periphery of the roll 16. In this state the pusher member 60 will be in its right-most position, i.e., closest to the center of the dispenser, under the urging of the spring 69 (see FIG. 13). Also, the releae arm 80 will be in its lowermost position, due to gravity, aided by the force of the torsion spring 91. As a result, the inclined rearwardly facing portion 83 of the bottom wall of the release arm 80 of the release mechanism 70 abuts an upper edge 16*a* of the roll 16 at a support location spaced outwardly from an initial inner periphery of the roll, and is cammed upwardly by the upper edge 16*a*. Hence, the release arm 80 is caused to pivot upwardly against the bias of the torsion springs 91 about a pivot axis defined by the axle 88. Eventually, the release arm 80 comes to rest on the upper surface 16*b* of the roll 16, as shown in FIG. 10.

It will be appreciated that the release mechanism accommodates rolls of varying height (i.e., longitudinal length), because of the ability of the release arm 80 to pivot upwardly. That is, the extent to which the release arm swings upwardly will be dependent upon the height of the roll 16. The greater the roll height, the greater will be the distance by which the release arm 80 swings upwardly.

When the front pusher arm 65 of the pusher member 60 abuts the outer periphery 16*c* of the roll 16 it may be pushed radially outwardly thereby, against the bias of the spring 69, by a distance dependent upon the diameter of the roll 16. In the embodiment according to FIGS. 10–11, a roll 16 of maximum diameter has been installed, whereby the pusher plate 60 has been displaced to its maximum outer position wherein the guide pins 67 of the pusher member 60 are disposed at the front end of the guide slots 56 of the base.

If the roll 16 had been of a smaller outer diameter, as depicted in FIG. 12 wherein a smaller diameter roll 16' has been installed, the pusher member 60 would not have been displaced radially outwardly (i.e., to the left) as far as in FIGS. 10 and 11. Also, the guide pins 96 of the release portion 90 would be situated farther outwardly (to the left) in the slots 87 of the release arm 80 in FIG. 12. Thus, the reason for making the release mechanism 70 of two parts 80 and 90 is to enable rolls of different outer diameter to be accommodated.

In any event, it will be appreciated that since the release arm 80 is mounted on the pusher member 60, the final position of that release arm 80 is dependent upon the final position of the pusher member 60.

In the state shown in FIG. 10, the guide pins 106 of the sign are captured in the rear portion 98*c* of the guide slots of the release slide 90, and the sign 100 is held in the rear (retracted) position.

As towels are removed from the inner periphery 16*d* of the roll, the radial thickness t of the roll diminishes and progresses outwardly. Eventually, the inner periphery reaches the lowermost portion 82*a* of the bottom wall 82 of the release arm 80, whereafter an inclined, forwardly facing portion 85 of the release arm 80 contacts the upper rear edge 16*e* of the release arm 80. Eventually, the thickness t' is so thin, e.g., one-eight of an inch, that the upper front edge 16*a* of the roll travels radially outside of a front end of the surface portion 85. Accordingly, the release arm becomes unsupported and drops downwardly about the axis of the pivot pins, due to gravity (see FIG. 11). As that happens, the release slide 90 swings downwardly with the release arm, whereupon the guide slots 98 force the guide pins 106 of the sign 100 forwardly until the sign comes to rest in the forward position, so that the user or custodian can see the "low" indicia (see FIG. 14).

It will be understood that since the supporting portion 80 is mounted on the pusher plate 60 and moves together therewith, the distance between the pusher arm 65 and the roll-contacting point on the bottom wall 82 of the release arm 80 will remain essentially constant during the towel dispensing phase, regardless of the horizontal location of the pusher member 50, i.e., regardless of the outer diameter of the roll. Thus, the sign 100 will always provide a low reserve indication in response to the same value of t'.

It will be appreciated that the low-reserve mechanism according to the present invention enables a user or custodian to be warned of a low-reserve state of an upright roll of paper towels in a dispenser. Furthermore, the low-reserve mechanism automatically adjusts to the height and outer diameter of the upright roll.

Also while it has been mentioned that springs can be provided to bias the release arm 80 downwardly, it may be possible to dispense with those springs and rely upon gravity alone if the design is such that insufficient friction will be generated that could cause the release arm to become hung-up.

It will also be appreciated that the feature of the invention wherein the low-reserve mechanism automatically adjusts to the roll diameter is optional. That is, the release mechanism, instead of being formed of two relatively movable parts 80, 90, could be formed of a single member, as shown in FIG. 15. That is, FIG. 15 shows an indicating mechanism 40' wherein the release mechanism 70' comprises a single element pivotably connected to a stationary upper housing 50' which also carries a pusher member 65' that abuts the outer periphery of the roll 16. The release mechanism 70' carries the guide slots 98' in which the guide pins 106' of the sign 100' slide. The indicator mechanism accommodates a roll of a given outer diameter and does not possess the ability to accommodate rolls of different outer diameter as does the mechanism of FIGS. 1–14.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A paper towel dispenser adapted for containing an upright roll of paper towels having an inner periphery exposed in use from which the towels are dispensed, the dispenser comprising:

a dispenser housing having a wall structure forming an inner chamber adapted to support the upright roll, the wall structure including a vertically open dispensing aperture therein for dispensing towels from the roll inner periphery; and a low-reserve indicator mechanism affixed to the dispenser housing within the chamber for indicating when a remaining quantity of towels in the roll is low, the indicator mechanism comprising:

an indicator mounted for movement between a retracted position, and an indicating position for establishing a low-reserve indication detectible from outside of the dispenser housing, and a release mechanism arranged to be supported upon an upwardly facing end of the roll at a support location spaced outwardly from an initial inner periphery of the roll, the release mechanism being movable downwardly in response to becoming unsupported by a diminishing radial thickness of the roll sufficient to cause the inner periphery of the roll to progress outwardly past the support location, the release mechanism being operably connected to the indicator to cause the indicator to move to its indicating position in response to the release mechanism moving downwardly.

2. The paper towel dispenser according to claim 1 wherein the indicator is mounted for rotation about a first horizontal axis.

3. The paper towel dispenser according to claim 2 wherein the release mechanism is mounted for rotation about a second horizontal axis and is connected to the indicator by a pin-and-slot connection.

4. The paper towel dispenser according to claim 1 wherein the indicator comprises an indicia-carrying sign, the wall structure configured to expose a portion of the sign when the sign is in its indicating position, wherein the indicia provides the low-reserve indication.

5. The paper towel dispenser according to claim 1 wherein the release mechanism includes a first portion adapted to rest upon a roll, and a second portion operably connected to the indicator, the first portion being displaceable vertically to adapt to rolls of different height.

6. The paper towel dispenser according to claim 5 wherein the first portion and the second portion are interconnected by a pin-and-slot connection.

7. The paper towel dispenser according to claim 5 wherein the indicator mechanism further includes an upper housing fixed to the wall structure, and a pusher member mounted to the upper housing for movement relative thereto, the pusher member including a downwardly extending pusher arm adapted to push against an outer periphery of the roll; the first portion being carried by the pusher, wherein a predetermined distance is maintained between the pusher arm and a point where the first portion rests on a roll.

8. The paper towel dispenser according to claim 7 wherein the first portion is movable horizontally relative to the second portion.

9. The paper towel dispenser according to claim 7 wherein the first portion of the release mechanism is pivotably connected to the pusher to define the second horizontal axis.

10. The paper towel dispenser according to claim 1 wherein the wall structure includes a lower wall defining a floor of the inner chamber and including the dispensing aperture.

11. The paper towel dispenser according to claim 1 wherein the wall structure includes an upright side wall, the indicator comprising a sign carrying low-reserve indicia which is visible through the side wall when the sign is in the indicating position.

12. The paper towel dispenser according to claim 1 wherein the indicator mechanism further includes a pusher arm arranged to abut against an outer periphery of the roll; the release mechanism being pivotably mounted for rotation about an axis whose location is fixed relative to the pusher arm.

13. The paper towel dispenser according to claim 1 wherein the indicator mechanism further comprises an upper housing affixed to the wall structure, the release mechanism being directly connected to the upper housing.

14. The paper towel dispenser according to claim 1 wherein the indicator mechanism further comprises an upper housing and a pusher member mounted to the upper housing for horizontal movement relative thereto; the pusher member including a downwardly depending pusher arm adapted to engage an outer periphery of the roll; the release mechanism being carried by the pusher member for movement therewith.

15. The paper towel dispenser according to claim 1 wherein the dispenser housing comprises front and rear sections hinged together, wherein the front section is swingable relative to the rear section about a vertical axis for opening and closing the dispenser; the indicator mechanism being mounted on the front section.

16. The dispenser according to claim 15 wherein the release mechanism is arranged to be automatically moved upwardly onto an upper end of the roll in response to abutting against a roll when the front section is swung closed, to enable the release mechanism to adapt to different roll heights.

17. The dispenser according to claim 15 wherein the indicator mechanism further includes an upper housing affixed to the wall structure of the dispenser housing; and a pusher member mounted to the base, the pusher member including a pusher arm arranged to abut an outer periphery of a roll, the pusher member being horizontally movable relative to the upper housing in response to the pusher arm abutting against a roll outer periphery when the front section is closed, to enable the pusher member to adapt to rolls of different outer diameter, the release mechanism being mounted on the pusher member.

18. The paper towel dispenser according to claim 17 wherein the release mechanism comprises a supporting portion connected to the upper housing, and a release portion connected to the indicator, the supporting portion and release portion being horizontally movable relative to one another.

19. The paper towel dispenser according to claim 1 wherein the release mechanism is arranged to remain stationary during an initial diminishing of a radial thickness of the roll.

20. A paper towel dispenser comprising:

a dispenser housing having front and rear sections, the rear section adapted to be anchored on a wall, and the front section being hinged to the rear section for being swung opened and closed about a vertical axis to selectively expose an inner chamber of the dispenser housing;

the dispenser housing including a vertically open aperture formed therein for dispensing towels from an exposed inner periphery of an upright roll disposed in the chamber; and a low-reserve indicator mechanism mounted to the front section and within the chamber for indicating when a quantity of towels in the roll is low, the low-reserve indicator mechanism comprising:

an upper housing affixed to the front section of the housing, a sign pivotably mounted to the upper housing for swinging movement between a retracted position and an indicating position, the sign carrying indicia visible from outside of the dispenser when the sign is in the indicating position, for indicating that a quantity of paper towels remaining in the roll is low, a pusher member mounted to the upper housing for movement relative thereto toward and away from a vertical axis of the discharge aperture, the pusher member including a downwardly depending pusher arm adapted to contact an outer periphery the roll of paper towels, and a release mechanism mounted on the pusher member for movement therewith, the release mechanism including:

a release arm pivotably mounted on the pusher member for up and down swinging movement, the release arm adapted to rest on the top end of the roll, and a release slide supported on the release arm by a first pin-and-slot connection, wherein the release slide is relatively movable relative to the release arm, the release slide being connected to the sign by a second pin-and-slot connection, whereby the release slide is swingable downwardly with the release arm when an inner periphery of the roll reaches a location radially outwardly of the supporting portion, to cause the sign to move from the retracted position to the indicating position.

21. A low-reserve indicator mechanism for indicating a low-reserve state of an upright roll of paper towels having an exposed inner periphery from which the towels are dispensed, the mechanism comprising:

an upper housing adapted to be fixed to a wall structure of a dispenser, the upper housing including a top wall and a pair of side walls depending downwardly from the top wall, the base defining front and rear ends;

an indicator arm pivotably mounted to the side walls of the upper housing for rotation about a first axis between a retracted position and an indicating position for indicating a low-reserve state of a roll of paper towels, a pusher member mounted to the side walls of the upper housing for sliding movement relative thereto in a front to rear direction and including a downwardly extending pusher arm adapted to engage an outer periphery of a roll of paper towels; and a release mechanism for actuating the indicator arm, the release mechanism comprising:

a release arm pivotably connected to the pusher member for rotation about a second axis extending generally parallel to the first axis, the release arm including a downwardly facing support surface adapted to be supported on an upper end of a roll of paper towels, and a release slide connected to the release arm by a first pin-and-slot connection to be displaceable relative thereto in a front-to-rear direction, and connected to the indicator arm by a second pin-and-slot connection for producing rotation of the indicator arm toward the indicating position in response to downward rotation of the release arm.

22. A paper towel dispenser adapted for containing an upright roll of paper towels having an inner periphery exposed in use from which the towels are dispensed, the dispenser comprising:

a dispenser housing having a wall structure forming an inner chamber adapted to support the upright roll, the wall structure including a rear section mountable to a fixed supporting wall and a front section mounted to the rear section to define a vertical parting plane therewith, the front section being movable relative to the rear section for opening and closing the inner chamber at the parting plane, the wall structure further including a vertically open dispensing aperture therein for dispensing towels from the roll inner periphery, the dispensing aperture defined by a substantially conical surface tapering away from the inner chamber to an outer free end of the conical surface; and a low-reserve indicator mechanism affixed to the front section of the dispenser housing within the chamber for indicating when a remaining quantity of towels in the roll is low, the indicator mechanism comprising:

an indicator mounted for movement between a retracted position, and an indicating position visible to a user viewing the front section of the dispenser housing in a direction perpendicular to the parting plane for establishing a low-reserve indication, and a release mechanism arranged to be supported upon an upper end of the roll adjacent an outer periphery thereof and movable downwardly in response to becoming unsupported by a diminishing radial thickness of the roll, the release mechanism being operably connected to the indicator to cause the indicator to move in its indicating position in response to the release mechanism moving downwardly.

23. A paper towel dispenser adapted for containing an upright roll of paper towels having an inner periphery exposed in use from which the towels are dispensed, the dispenser comprising:

a dispenser housing having a wall structure forming an inner chamber adapted to support the upright roll, the wall structure including a vertically open dispensing aperture therein for dispensing towels from the roll inner periphery; and a low-reserve indicator mechanism affixed to the dispenser housing within the chamber for indicating when a remaining quantity of towels in the roll is low, the indicator mechanism comprising:

an indicator mounted for rotation about a first axis for movement between a retracted position, and an indicating position for establishing a low-reserve indication detectible from outside of the dispenser housing, and a release mechanism arranged to be supported upon an upper end of the roll adjacent an outer periphery thereof and movable downwardly in response to becoming unsupported by a diminishing radial thickness of the roll, the release mechanism being operably connected to the indicator to cause the indicator to move to its indicating position in response to the release mechanism moving downwardly.

24. A paper towel dispenser adapted for containing an upright roll of paper towels having an inner periphery exposed in use from which the towels are dispensed, the dispenser comprising:

a dispenser housing having a wall structure forming an inner chamber adapted to support the upright roll, the wall structure including a vertically open dispensing aperture therein for dispensing towels from the roll inner periphery; and a low-reserve indicator mechanism affixed to the dispenser housing within the chamber for indicating when a remaining quantity of towels in the roll is low, the indicator mechanism comprising:

an indicator mounted for rotation about a first axis movement between a retracted position, and an indicating position for establishing a low-reserve indication detectible from outside of the dispenser housing, and a release mechanism arranged to be supported upon an upper end of the roll adjacent an outer periphery thereof and movable downwardly in response to becoming unsupported by a diminishing radial thickness of the roll, the release mechanism being operably connected to the indicator to cause the indicator to move to its indicating position in response to the release mechanism moving downwardly, wherein the indicator comprises an indicia-carrying sign, the wall structure configured to expose a portion of the sign when the sign is in its indicating position, wherein the indicia provides the low-reserve indication.

25. A paper towel dispenser adapted for containing an upright roll of paper towels having an inner periphery exposed in use from which the towels are dispensed, the dispenser comprising:

dispenser housing having a wall structure forming an inner chamber adapted to support the upright roll, the wall structure including a vertically open dispensing aperture therein for dispensing towels from the roll inner periphery; and a low-reserve indicator mechanism affixed to the dispenser housing within the chamber for indicating when a remaining quantity of towels in the roll is low, the indicator mechanism comprising:

an indicator mounted for rotation about a first axis movement between a retracted position, and an indicating position for establishing a low-reserve indication detectible from outside of the dispenser housing, and a release mechanism arranged to be supported upon an upper end of the roll adjacent an outer periphery thereof and movable downwardly in response to becoming unsupported by a diminishing radial thickness of the roll, the release mechanism being operably connected to the indicator to cause the indicator to move to its indicating position in response to the release mechanism moving downwardly, wherein the wall structure includes an upright side wall, the indicator comprising a sign carrying low-reserve indicia which is visible through the side wall when the sign is in the indicating position.

26. A paper towel dispenser adapted for containing an upright roll of paper towels having an inner periphery exposed in use from which the towels are dispensed, the dispenser comprising:

a dispenser housing having a wall structure forming an inner chamber adapted to support the upright roll, the wall structure including a vertically open dispensing aperture therein for dispensing towels from the roll inner periphery; and a low-reserve indicator mechanism affixed to the dispenser housing within the chamber for indicating when a remaining quantity of towels in the roll is low, the indicator mechanism comprising:

an indicator mounted for rotation about a first axis movement between a retracted position, and an indicating position for establishing a low-reserve indication detectible from outside of the dispenser housing, and a release mechanism arranged to be supported upon an upper end of the roll adjacent an outer periphery thereof and movable downwardly in response to becoming unsupported by a diminishing radial thickness of the roll, the release mechanism being operably connected to the indicator to cause the indicator to move to its indicating position in response to the release mechanism moving downwardly, wherein the indicator mechanism further includes a pusher arm arranged to abut against an outer periphery of the roll; the release mechanism being pivotably mounted for rotation about an axis whose location is fixed relative to the pusher arm.

27. A paper towel dispenser adapted for containing an upright roll of paper towels having an inner periphery exposed in use from which the towels are dispensed, the dispenser comprising:

a dispenser housing having a wall structure forming an inner chamber adapted to support the upright roll, the wall structure including a vertically open dispensing aperture therein for dispensing towels from the roll inner periphery; and a low-reserve indicator mechanism affixed to the dispenser housing within the chamber for indicating when a remaining quantity of towels in the roll is low, the indicator mechanism comprising:

an indicator mounted for rotation about a first axis movement between a retracted position, and an indicating position for establishing a low-reserve indication detectible from outside of the dispenser housing, and a release mechanism arranged to be supported upon an upper end of the roll adjacent an outer periphery thereof and movable downwardly in response to becoming unsupported by a diminishing radial thickness of the roll, the release mechanism being operably connected to the indicator to cause the indicator to move to its indicating position in response to the release mechanism moving downwardly, wherein the indicator mechanism further comprises an upper housing and a pusher member mounted to the upper housing for horizontal movement relative thereto; the pusher member including a downwardly depending pusher arm arranged to engage an outer periphery of the roll; the release mechanism being carried by the pusher member for movement therewith.

* * * * *

UNITED STATES PATENT AND TRADEMARK OFFICE

CERTIFICATE OF CORRECTION

Figure 7:
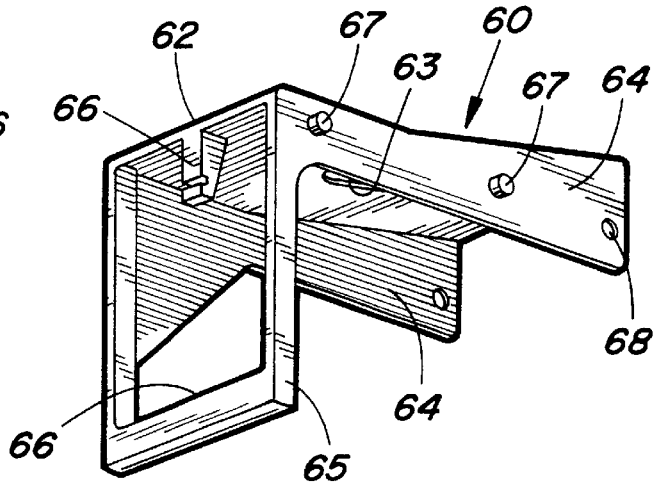
FIG. 7 is a front bottom perspective view of a pusher member of the indicator mechanism.
Figure 8:
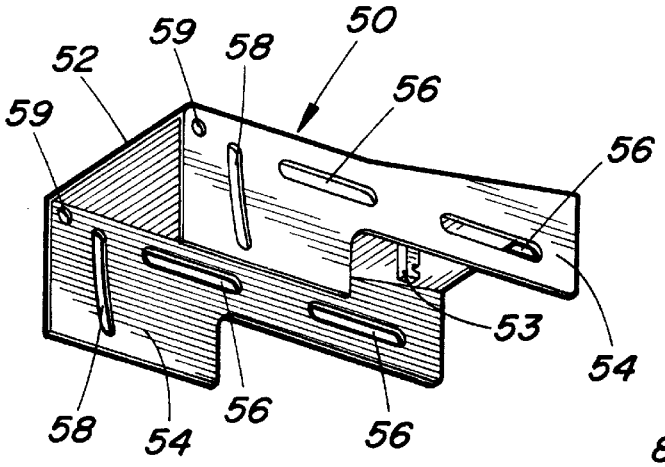
FIG. 8 is a front bottom perspective view of a base member of the indicator mechanism.
Figure 9:
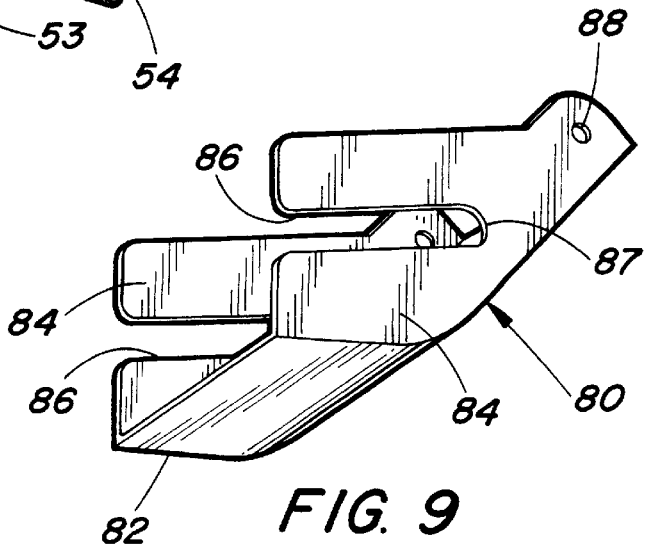
FIG. 9 is a front bottom perspective view of a supporting portion of a release mechanism of the indicator of mechanism.

PATENT NO. : 6,517,025 B1
APPLICATION NO. : 09/713317
DATED : February 11, 2003
INVENTOR(S) : Gregory D. Budz It is certified that error appears in the above-identified patent and that said Letters Patent is hereby corrected as shown below:

IN THE DRAWINGS:

Sheet 3, change reference "66" at top of FIG. 7 to reference --76--.

IN THE SPECIFICATION:

Column 3, lines 34-35, change "supporting portion 80" to --release arm 80--.

Column 3, line 36, change "leg 66" to --leg 76--.

Column 4, line 41, change "axle 88" to --axle 89--.

Column 4, line 66, delete "slots 87" to-- slots 86 --.

Column 5, line 18, change "release arm 80" to --roll 16--.

Column 5, line 29, change "supporting portion 80" to --release arm 80--.

Column 5, line 35, change "pusher member 50" to --pusher member 60--.

Signed and Sealed this

Sixth Day of March, 2007

JON W. DUDAS
*Director of the United States Patent and Trademark Office*